US009127541B2

(12) United States Patent
Burnham et al.

(10) Patent No.: US 9,127,541 B2
(45) Date of Patent: Sep. 8, 2015

(54) HEATER AND METHOD FOR RECOVERING HYDROCARBONS FROM UNDERGROUND DEPOSITS

(75) Inventors: Alan K. Burnham, Livermore, CA (US); P. Henrik Wallman, Berkeley, CA (US); James R. McConaghy, Salida, CO (US); Roger L. Day, Rifle, CO (US)

(73) Assignee: AMERICAN SHALE OIL, LLC, Denver, CO (US)

( * ) Notice: Subject to any disclaimer, the term of this patent is extended or adjusted under 35 U.S.C. 154(b) by 964 days.

(21) Appl. No.: 13/127,969

(22) PCT Filed: Nov. 2, 2009

(86) PCT No.: PCT/US2009/062995

§ 371 (c)(1), (2), (4) Date: Dec. 28, 2011

(87) PCT Pub. No.: WO2010/053876

PCT Pub. Date: May 14, 2010

(65) Prior Publication Data

US 2012/0205109 A1 Aug. 16, 2012

Related U.S. Application Data

(60) Provisional application No. 61/112,088, filed on Nov. 6, 2008.

(51) Int. Cl.
*E21B 43/243* (2006.01)

(52) U.S. Cl.
CPC ..... *E21B 43/243* (2013.01)

(58) Field of Classification Search
CPC ..... E21B 43/24; E21B 43/243
USPC ..... 166/272.1, 302, 57, 58, 59
See application file for complete search history.

(56) References Cited

U.S. PATENT DOCUMENTS

| | | | | | |
|---|---|---|---|---|---|
| 3,107,728 | A | * | 10/1963 | Kehn | 166/59 |
| 3,275,497 | A | * | 9/1966 | Weiss et al. | 427/350 |
| 3,497,000 | A | * | 2/1970 | Hujsak et al. | 166/59 |
| 4,446,917 | A | * | 5/1984 | Todd | 166/59 |
| 4,495,059 | A | * | 1/1985 | Wallman | 208/410 |

(Continued)

OTHER PUBLICATIONS

International Search Report issued in PCT/US2009/062995, mailed May 20, 2010 3 pages.

*Primary Examiner* — Brad Harcourt
*Assistant Examiner* — David Carroll
(74) *Attorney, Agent, or Firm* — Perkins Coie LLP

(57) ABSTRACT

Heaters are presented to aid in the recovery of hydrocarbon from underground deposits. A heater is provided to a well that has been drilled through an oil-shale deposit. A fuel and an oxidizer are provided to the heater and flue gases are recovered. The heater has a counterflow design and provides a nearly uniform temperature along the heater length. The heater may be designed to operate at different temperatures and depths to pyrolyze or otherwise heat underground hydrocarbon deposits to form a product that is easily recovered and which is useful without substantial further processing. Various counterflow heaters are described including heaters having, down the heater length, distributed reaction zones, distributed catalytic oxidation of the fuel, and discrete or continuous heat generation. The heaters may also utilize inert gases from product recovery or from heater flue gases to control the heater temperature.

16 Claims, 6 Drawing Sheets

(56) References Cited

U.S. PATENT DOCUMENTS

| | | | | |
|---|---|---|---|---|
| 4,809,672 | A * | 3/1989 | Kendall et al. | 126/91 A |
| 5,862,858 | A | 1/1999 | Wellington et al. | |
| 5,899,269 | A * | 5/1999 | Wellington et al. | 166/58 |
| 5,992,409 | A * | 11/1999 | Heimlich et al. | 126/91 A |
| 6,358,040 | B1 * | 3/2002 | Pfefferle et al. | 431/7 |
| 7,343,971 | B2 | 3/2008 | Pfefferle | |
| 2003/0146002 | A1 * | 8/2003 | Vinegar et al. | 166/384 |
| 2004/0011523 | A1 * | 1/2004 | Sarada | 166/244.1 |

* cited by examiner

HEATER AND METHOD FOR RECOVERING HYDROCARBONS FROM UNDERGROUND DEPOSITS

CROSS-REFERENCE TO RELATED APPLICATIONS

The present application claims the benefit of U.S. Provisional Application Ser. No. 61/112,088, titled the same, filed on Nov. 6, 2008, the disclosure of which is hereby incorporated by reference in its entirety.

FIELD OF THE INVENTION

The present invention generally relates to apparatus and methods for facilitating the recovery of hydrocarbon products from underground deposits, and more particularly to a method and system for in situ heating of oil shale to recover liquid shale oil.

BACKGROUND

Large underground oil shale deposits are found both in the US and around the world. In contrast to petroleum deposits, these oil shale deposits are characterized by their solid state; in which the organic material is a polymer-like structure often referred to as "kerogen" intimately mixed with inorganic mineral components. Heating oil shale deposits to a temperature of about 300 C. has been shown to result in the pyrolysis of the solid kerogen to form petroleum-like "shale oil" and natural-gas like gaseous products. The economic extraction of products derived from oil shale is hindered, in part, by the difficulty in efficiently heating underground oil shale deposits.

Thus there is a need in the art for a method and apparatus that permits the efficient in situ heating of large volumes of oil-shale deposits.

SUMMARY

The present application addresses some of the disadvantages of known systems and techniques by providing an apparatus for the heating of large underground volumes. In one embodiment, a heater is provided that can heat to a specified temperature along the length of the heater.

In general, the heater accepts fuel and oxidizer and is designed to promote exothermic reaction zones along the length of the heater. In various embodiments, the heater includes mixing regions for the fuel and oxidizer, and reactions occur within the mixture at the mixing regions, on catalytic surfaces, or some combination thereof.

These features together with the various ancillary provisions and features which will become apparent to those skilled in the art from the following detailed description are attained by the apparatus and method of the present disclosure, preferred embodiments thereof being shown herein.

DETAILED DESCRIPTION

Figure 1:
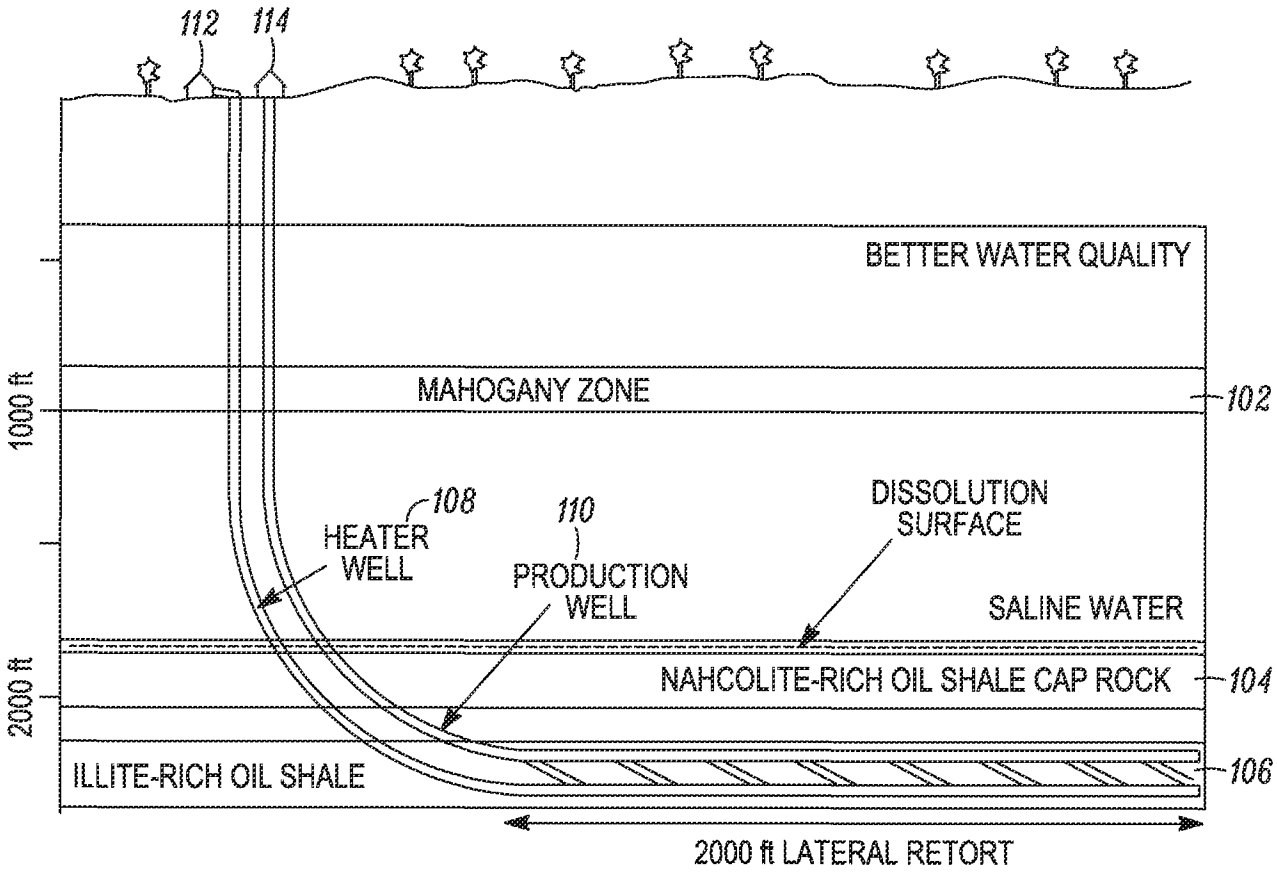
FIG. 1 is a schematic of an oil-shale rich site in Colorado's Green River Formation.

FIG. 1 is an elevation view of an oil-shale rich site 100 in Colorado known as the Green River Formation. FIG. 1 is an exemplary, non-limiting illustration. Some of the layers shown in the elevation view include, at increasing depth, a Mahogany Zone 102, a Nahcolite-rich Oil Shale Cap Rock Layer 104, and an Illite-rich Oil Shale Zone 106. The distances shown are approximate and give a rough idea of the geology of the formation. The region above the Mahogany Zone 102 typically has good water quality. The salinity of the water increases as the Nahcolite-rich Oil Shale Cap Rock Layer 104 is approached. The Illite-rich Oil Shale Zone 106 has a low permeability.

One exemplary process to extract kerogen, in situ, includes heating the Illite-rich Oil Shale Zone 106 to the pyrolysis temperature. Heat may be provided by a heat source via a heater well 108. Fluid kerogen may be removed via a production well 110. In-situ extraction is further described in co-pending U.S. patent application Ser. No. 11/655,152, titled In-Situ Method and System for Extraction of Oil From Shale, filed Jan. 19, 2007, incorporated herein by reference as if set out in full. As can be seen, both the heater well 108 and the production well 110 have a section extending in the Illite-rich Oil Shale Zone 106. While shown as a horizontal well section, the wells may be horizontal, vertical, or any angle therebetween.

In one embodiment, the heater well 108 may include a counter-flow heat exchanger to preheat combustible fluids (explained more fully below), which are then combusted to generate heat in the Illite-rich Oil Shale Zone 106. In another embodiment, the heater well 108 may include a down-hole burner within the Illite-rich Oil Shale Zone 106. The heater well 108 provides heat for pyrolyzing the shale such that the kerogen is converted to fluids that can be extracted through the production well 110. The combustible fluids supplied to the heater well may in various embodiments, including a mixture rich in oxygen and/or containing carbon dioxide, be recovered on the surface from the production well 110 or the heater well 108. In this context, the term fluid is intended to encompass both liquids and gases.

The shale volume targeted for heating is referred to as the "retort." The heater forms an underground retort in a deposit by transferring heat by conduction and convection of heated fluids to the retort volume, converting the deposit into recoverable hydrocarbon liquids and gases. Thus, for example and without limitation, an oil-shale may be pyrolyzed to form synthetic crude oil, which may then be extracted through another well. In some embodiments, the retort will extend from 50 ft to 100 ft from the heater, for example.

The temperature required to facilitate removal of the underground deposits depends on the chemical nature and/or physical state of the deposit and the depth. In general, the heaters disclosed herein can be configured to operate over a range of temperatures and at a range of depths and configurations, to facilitate removal of many types of deposits, including but not limited to, shale, tar sand, and heavy-oil deposits. Examples presented herein are for illustrative purposes, and are not meant to be limiting. In one embodiment, the heater temperature is greater than the pyrolysis temperature of the kerogen, and less than the temperature at which the shale oil cokes on the heater surface.

Because oil shale deposits typically contain large amounts of inorganic material mixed with the kerogen, and these inorganic materials are heated along with the kerogen, the efficient heating of the retort is desirable. One efficient heating method for recovery of shale oil is to drill one or more wells into the shale deposit, install downhole heaters in one or more wells for heating the oil shale in situ, and thus pyrolyze the kerogen to liquid and gaseous products recoverable through one or more production wells.

If the deposit in the region of the retort has uniform physical and chemical properties, and if the heating is uniform along the heater, then the retort will develop uniformly along the heater. Thus, for example, a long straight heater producing uniform heating will form a cylindrical retort. Longitudinal variations in heating may result in non-cylindrical retort shapes. Such variations in retort shape may result in a system that does not efficiently process all of the oil shale near the retort, and may require the heater to be shut down until uniformity is reestablished. For this reason, it is preferred that the heating be such that the radial extent of the retort does not vary appreciably along the length of the heater.

Figure 2:
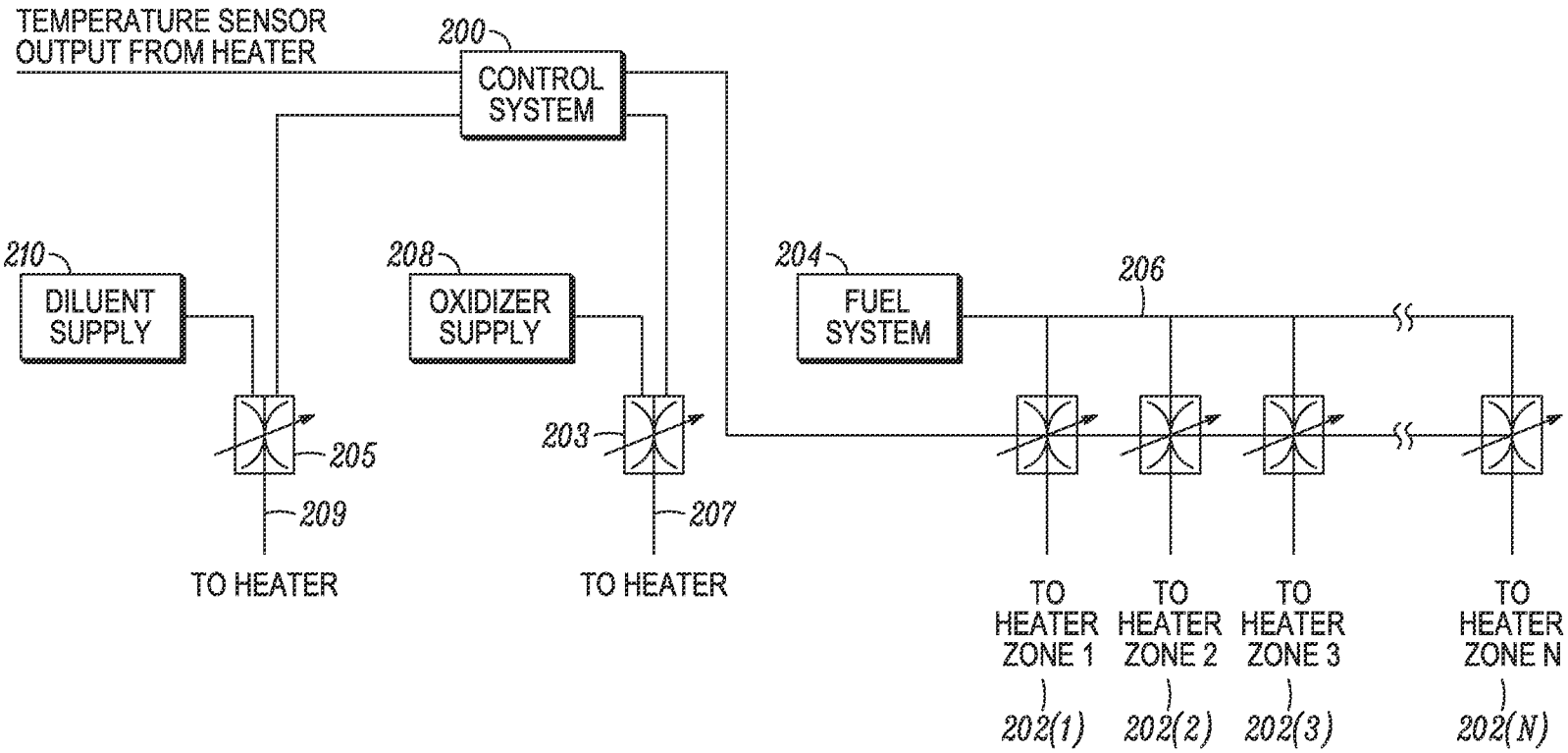
FIG. 2 is a schematic of some of the elements for heater control that may be contained within the Heater Control Building.

Also shown in FIG. 1 are a Heater Control Building 112 and a Shale Oil Recovery Building 114. In one embodiment, retort heating is achieved by underground reaction of a fuel and oxidizer. Alternatively, retort heating may be supplemented by electrical heating of the heater. FIG. 2 is a schematic of some of the elements for heater control that may be contained within the Heater Control Building 112. Heater Control Building 112 may include: a controller 200, one or more adjustable valves 202(1)-202(N) connecting a fuel supply 204 and the heater fuel line 206; one or more adjustable valves 203 connecting an oxidizer supply 208 and an oxidizer line 207; and one or more optional adjustable valves 205 connecting a source of diluent 210 and a diluent supply line 209. Adjustable valves 203 and 205 may be arranged similar to the manifold associated with adjustable valves 202. Heater Control building 112 may also include devices or mixing fluids (not shown). For example, some embodiments may provide premixed fuel, oxidizer, diluent, or mixtures thereof.

In one embodiment, fluids are controllably provided to different regions of the heater well 108, as described subsequently. Thus, for example and without limitation, the supplies of fuel, oxidizer, and/or diluent may be regulated independently and provided by plumbing to different portions of the heater ("Heater Zones"). In yet another embodiment, temperature sensor devices are provided along the length of the Heater. As an example, thermocouples or resistance temperature detectors (RTD) are strategically placed along the heater, near or on the outer surface of the heater. Through judicious adjustment of the fuel supply, the heater may be operated to obtain temperature uniformity. Alternatively, electrical resistance heaters may be used to provide additional heating to achieve temperature uniformity along the heater.

In one embodiment, the temperature along the heater varies by no more than 10 C. In another embodiment, the temperature along the heater varies by no more than 20 C. In yet another embodiment, the temperature along the heater varies by no more than 10 C over 10 meter lengths of the heater. In another embodiment, the temperature along the heater varies by no more than 20 C over 10 meter lengths of the heater. In another embodiment, the temperature along the length of the heater varies by less than 40 C. In yet another embodiment, the temperature along the heater varies by less than 100 C.

In one embodiment, the heat flux along the heater varies by no more than 10%. In another embodiment, the heat flux along the heater varies by no more than 20%. In yet another embodiment, the heat flux along the heater varies by no more than 10% over 10 meter lengths of the heater. In another embodiment, the heat flux along the heater varies by no more than 20% over 10 meter lengths of the heater. In yet another embodiment, the retort may not have constant heat transfer characteristics. Thus, for example, the flow of oil vapors may increase the heat transfer over some parts of the heater. Variations in heat transfer may be compensated by purposely providing variations in heat flux and/or temperature either longitudinally or circumferentially.

In one embodiment, the heater is sized to fit within a perforated well casing within the retort. The perforated casing provides mechanical protection from spalling rock fragments that can break loose from the well wall. Thus, for example, the heater is sized to fit within a well casing having a circular opening of from 150 mm to 500 mm in diameter. In various embodiments the heater is cylindrical and has a diameter of from 150 mm to 300 mm. In various embodiments, the heater has a diameter of approximately 150 mm, of approximately 200 mm, of approximately 250 mm, or approximately 300 mm.

Studies have shown that the profitability of extraction from oil shale deposits improves with lateral retort length, i.e., the longer the retort served by one heater well, the lower the cost due to the substantial cost of the wells. The disclosed heater may heat very long retorts to a uniform temperature. In one embodiment, the length of the heater is, for example and without limitation, greater than 1000 m. In alternative embodiments, the heater has a length greater than 100 m, greater than 200 m, greater than 300 m, greater than 400 m, greater than 500 m, greater than 600 m, greater than 700 m, greater than 800 m, or greater than 900 m. In other alternative embodiments, the heater has a length greater than 1500 m, or greater than 2000 m.

Conversion of kerogen in the oil shale deposit to liquid and/or gaseous products by pyrolysis also facilitates the separation of the organic components from the inorganic constituents of the shale that are present in large quantities.

In one embodiment, a heater for underground heating of shale, tar sand, and heavy-oil deposits is provided. The heater may be installed, for example, in a horizontal well. Upon heating, the deposits form boiling oil that is maintained at a temperature that depends on the deposit composition and depth. For many underground deposits, temperatures of interest are from 275 C to 450 C. In one embodiment, the oil boils at about 350 C.

In another embodiment, a heater may be installed in a horizontal well that traverses a deposit, such as an oil-shale deposit. In another embodiment, the product contacting the heater liquefies, as the result of heating and/or pyrolysis, and forms a boiling liquid that contacts a length of the heater. In one embodiment, the deposit is heated to a boiling point, which will vary with the type of deposit and the depth. Thus, for example, the heater, once operating, is preferably surrounded by underground boiling product oil maintained at approximately 350 C.

In yet another embodiment, a heater includes a counterflow heat exchanger. A gaseous or liquid fuel and gaseous oxidizer, which may be diluted, and which may be premixed or supplied separately, are provided to the heater. The fuel and oxidizer react exothermically and form "flue gases" which counter flow through the heat exchanger and preheat the incoming gases. The released heat preheats the incoming fuel and/or oxidizer and/or diluent and an outer housing of the heater. The heating may take place over some or all of the length of the heater. In certain other embodiments, the fuel and oxidizer react within the heater, in the gas phase or on a surface promoted by a catalyst. The resulting flue gases flow counter to the incoming fluids, preheating the fuel and oxidizer as they flow into the burner and also heating an outer pipe of the heater.

In one embodiment, the supply and flue gas lines from the ground surface to the heater are arranged to provide counterflow heat exchange. The flue gas is thus cooled to approximately 25 C, for example, by the time it reaches the surface, and the fuel and oxidizer are preheated up to the maximum flue gas temperature, which may be, for example, approximately 400 C, or approximately 500 C prior to entering the heater.

In certain embodiments, the fuel and oxidizer may, in various embodiments, include a stoichiometric proportion or a fuel lean (oxidizer rich) proportions. In some embodiments, the fuel and oxidizer are premixed, and in other embodiments the fluids are supplied separately and are mixed at reaction zones along the heater. Alternatively, a diluent may be added to the fuel, oxidizer, or mixture thereof. The diluent may be, but is not limited to, carbon dioxide recovered on the surface from the production well.

In certain other embodiments, specifically where fuel/oxidizer reactions within the heater are not sufficiently complete for the flue gas to meet emission or sequestration requirements, a catalytic converter may be provided at the flue gas exits of the heater to eliminate residual hydrocarbons and CO at a location where the temperature is high enough to support the catalytic oxidation.

In other embodiments, some of the flue gases may be recycled back into the heater by mixing them with the fuel, oxygen, or a mixture thereof.

The following are illustrative of several heater embodiments, which should not be construed as limiting.

Permeable Catalytic Material Heater

Figure 3:
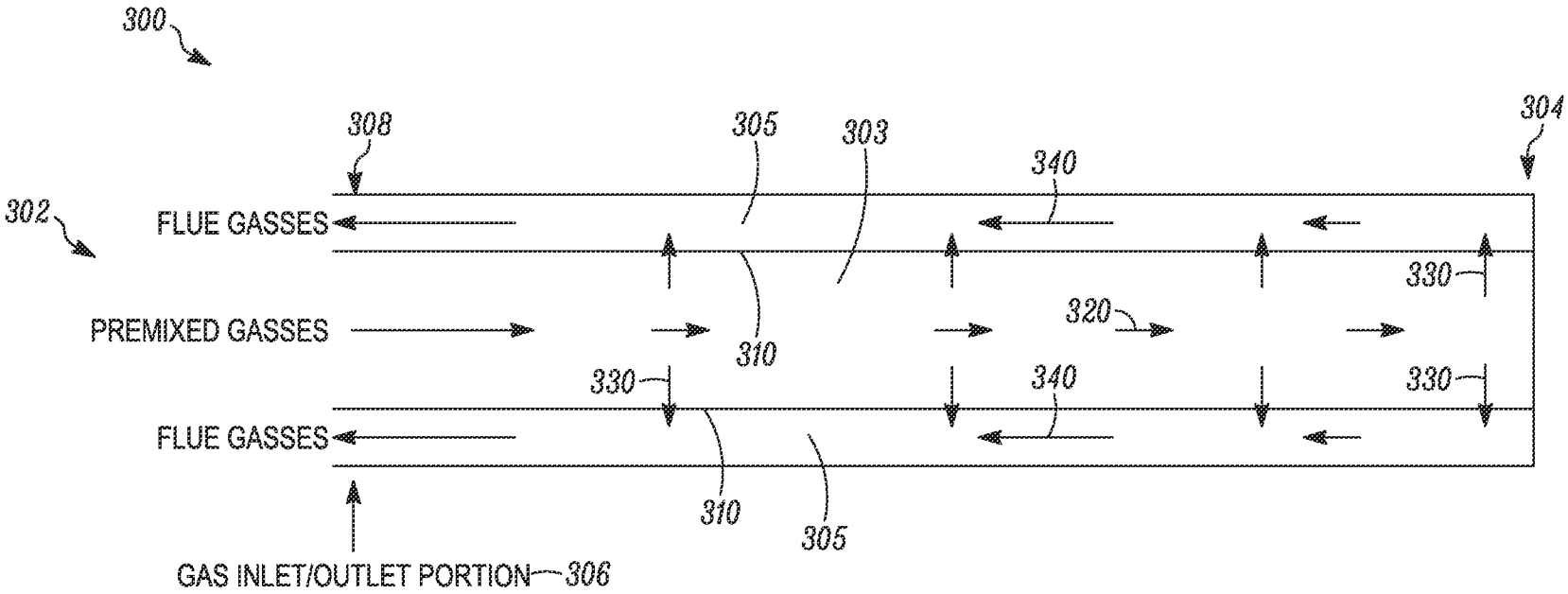
FIG. 3 is a schematic illustrating an exemplary embodiment of a heater in the form of a Permeable Catalytic Material Heater.

One embodiment of a heater is shown in FIG. 3 as a Permeable Catalytic Material Heater 300. The heater embodiment of FIG. 3 may include one or more of the elements described above, as appropriate. The heater of FIG. 3 has an open end 302 that has a Gas Inlet/Outlet portion 306 that provides both gas inflow and outflow, and a Closed Heater End 304. The heater 300 includes an elongated Burner Housing 308 suitable for placing in a well. Interior to the Burner Housing 308 is a Flow Restriction Medium 310 that extends to the Closed Heater End 304. In this exemplary embodiment, the Flow Restriction Medium 310 divides the interior volume of the Burner Housing 308 into an Inner Flow Passageway 303 and an Outer Flow Passageway 305, sometimes referred to as a first housing region and a second housing region. At least a portion of the Flow Restriction Medium 310 is formed from a permeable catalytic material that uses a selected permeability to provide a controlled transverse flow from the Inner to the Outer Flow Passageways. Although the embodiment of FIG. 3 shows a cylindrical Burner Housing and a cylindrical Flow Restriction Medium, this configuration is for illustrative purposes, and is not limited to this geometry. In one alternative embodiment, the Outer Flow Passageway extends along the Heater, but does not include the Closed Heater End. In another alternative embodiment, the flow travels from the Outer Flow Passageway to the Inner Flow Passageway.

Premixed fluids, which include a fuel and an oxidizer, are provided through the well from the surface into the Gas Inlet/Outlet Portion 306 and flow through the inner Flow Passageway 303 towards the Closed Heater End 304, as indicated by axial arrows 320. The Premixed Gases may be a stoichiometric or fuel lean mixture, and may include diluent to lower the reaction temperature. The diluent may be recovered Flue Gases, inert gases recovered from the production well, or other non-reactive gases, such as nitrogen contained in air.

The premixed fluids also flow through the permeable catalytic material 310, as indicated by the radial arrows 330, where they react to form Flue Gases that flow away from the Closed Heater End 304, as indicated by axial arrows 340. The distribution of flow through the permeable catalytic material 310 is affected by fluid properties and pressures and the porosity, thickness, and area of the permeable catalytic material. The heat of reaction of the premixed fluids heats the Flow Restriction Medium 310, the premixed fluids, Flue Gases, and the Housing 308. Complete reaction of the premixed: fluids in the catalytic material is desirable to achieve the maximum temperature rise across the catalytic material. A large pressure drop through the catalytic material facilitates the axial distribution of premixed fluids, which should be uniform for uniform heating of the Heater 300.

The Flue Gases flow from the Flow Restriction Medium 310 through the Outer Flow Passageway 305 towards the Gas Inlet/Outlet Portion 306, and eventually through the well and to the surface.

In one embodiment, the flow of fuel and oxidizer through the Flow Restriction Medium 310 is approximately constant along the burner length. Thus, for example and without limitation, the flow rate varies by less than 5% along the burner length, except near the ends of the burner. In another embodiment, the flow rate varies by less than 2%.

The Flow Restriction Medium 310 provides a means to achieve a desired, controlled, transverse flow profile along the length of the heater between the Inner and Outer flow Passageways. The Flow Restriction Medium 310 can be continuous or non-contiguous, comprised of porous and non-porous segments, comprised of porous panels in an otherwise solid pipe wall, or any combination of the preceding. In other embodiments, the porous panels may be made of sintered metal frit, ceramic frit, or small holes in the wall separating the Inner and Outer Flow Passageways.

In one embodiment, a small flow rate variation through the Flow Restriction Medium 310 and along the Burner 300 is provided by a Flow Restriction Medium with an approximately constant permeability with a pressure drop through the Flow Restriction Medium that is greater than the pressure drop along Outer Flow Passageway 305. Alternatively, a small flow rate variation through the Flow Restriction Medium 310 and along the Burner 300 is provided by a Flow Restriction Medium 310 having a permeability that increases with distance along the burner, matching the pressure drop through the Flow Restriction Medium to the pressure as it varies along the Outer Flow Passageway 305. In yet another embodiment, a small flow rate is provided by having different areas of a uniformly permeable material along the length of the Flow Restriction Medium to match the pressure drop between the Inner and Outer Flow Passageways.

In one embodiment, the permeable catalytic material portion of the Flow Restriction Medium 310 has a diameter of 200 mm and a wall thickness of a few mm (for example, 10 mm). The Housing 308, in one embodiment, is a stainless steel tube having a diameter of approximately 300 mm. The permeable catalytic material may be, for example and without limitation, a sintered stainless steel or specially alloyed steel. Alternatively, the catalytic material includes a noble metal, such as palladium or platinum, on sintered alumina. The permeability constant of the permeable catalytic material may be, for example and without limitation, from 0.1 to 1.0 mDarcy. These values are merely illustrative, with the actual values chosen to distribute reactions of the Premixed Gases such that the Housing maintains an approximately constant temperature.

In one embodiment, the premixed fluids include a gaseous stoichiometric fuel/oxidizer mixture with 2 wt % $CH_4$ and 8 wt % $O_2$ with an adiabatic temperature rise of about 900 C.

In another embodiment, the premixed fluids are fuel lean, with a $CH_4$ flow rate of 0.02 kg/s and an $O_2$ flow rate of 0.08 kg/s. This mixture is further diluted with the addition of 1.0 kg/s of an inert gas which may be, for example and without limitation, $CO_2$, $H_2O$, or $N_2$. The premixed gases are provided at low temperature (near room temperature) and high pressure (approximately 30 atm). The flue gas outlet pressure is from 15-20 atm, and the casing is maintained at about 410 C. to maintain a boiling oil pool external to the pipe at approximately 400 C.

The counterflow arrangement of premixed fluids and Flue Gases heats the premixed fluids as they flow through the Inner Flow Passageway 303 by the returning hot Flue Gases in the Outer Flow Passageway 305, and reach a temperature that does not vary down significantly down the length of the burner. In one embodiment, the premixed fluids are heated to a temperature of approximately 400 C a short distance into the Heater.

As the premixed fluids flow down the heater, the fluid permeates through the catalytic material and undergoes catalytically activated exothermic reaction of the fuel and oxidizer. The heat released in reaction increases the catalytic material to a temperature that is approximately constant along the length of the burner. In one embodiment, the catalytic material reaches a temperature to about 450 C.

Another embodiment involves recycling a portion of the exiting flue gas to the inlet or feed side. In this embodiment 1.0 kg/s of flue gas is recycled through a recycle ejector-type compressor. The motive gas for the ejector may be the oxidizer or fuel supply, such as the oxygen feed or the $CH_4$ feed. In the gas-recycle embodiment, the permeability of the catalytic material should be higher to reduce the overall pressure drop. Thus, for example and without limitation, the permeability may vary from 1.0 mDarcy at the inlet to 100 mDarcy toward the closed end of the burner.

In one embodiment, the inner tube is electrically conductive and may be electrically heated along the length to provide an external heat source for initially raising the heater temperature high enough for the catalytic surfaces to become active.

In one embodiment, a pilot burner near the entrance of the inner tube provides a heat source for initially raising the heater temperature high enough for the catalytic surfaces to become active.

Burner or Catalytic Bed Heater

Figure 4:
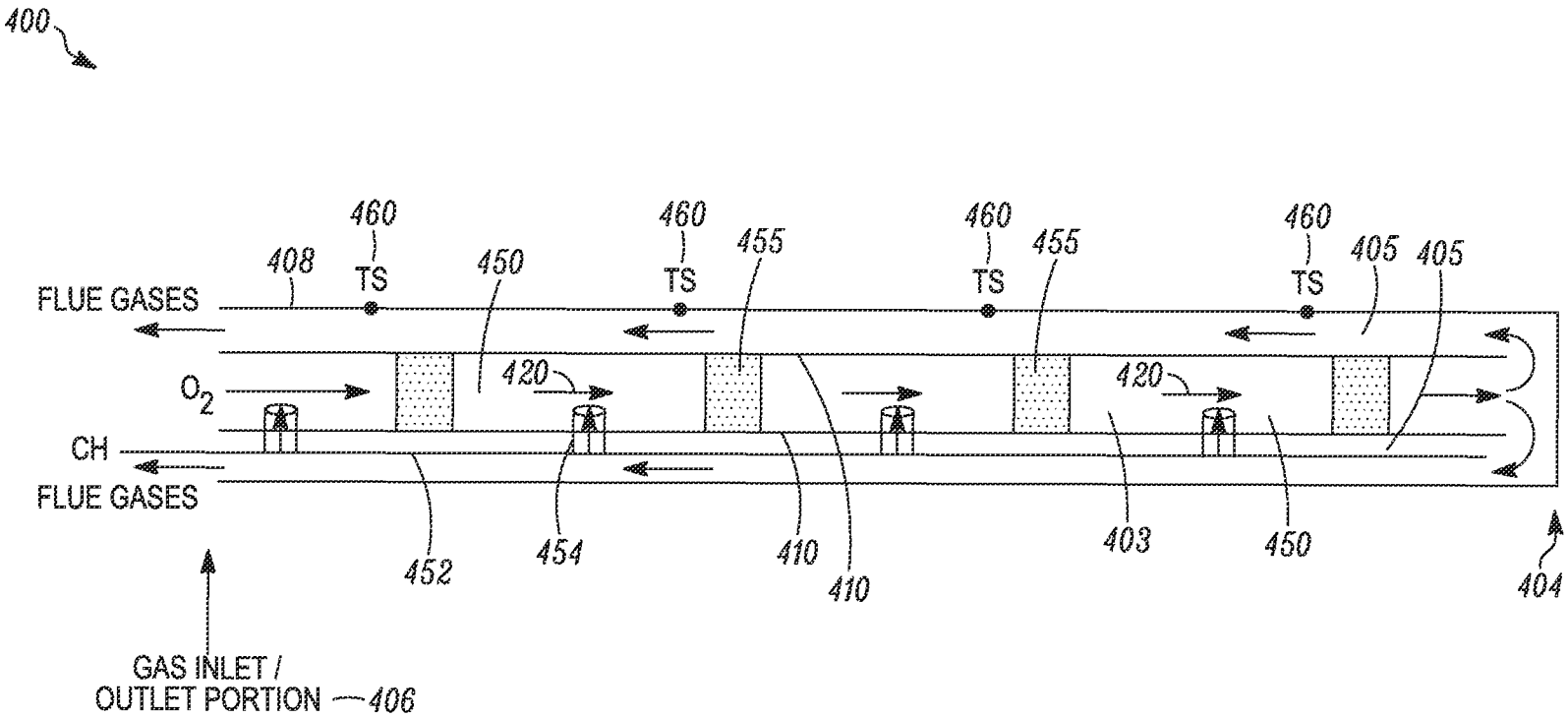
FIG. 4 is a schematic illustrating another exemplary embodiment of a heater in the form of a Catalytic Bed Heater.

Another embodiment of a heater is shown in FIG. 4 as a Catalytic Bed Heater 400. The heater embodiment of FIG. 4 may include one or more of the elements described above, as appropriate. The Heater 400 of FIG. 4 provides a number of discrete reaction zones 450. As described below, the Heater 400 of FIG. 4 is provided with a near stoichiometric fuel and oxidizer mixture. The oxidizer may be pure oxidizer, such as pure oxygen, or may include a non-reactive diluent. At each reaction zone, a portion of the fuel is mixed and reacted with the oxidizer, producing a more dilute oxidizer mixture. At the last reaction zone, the last of the fuel is reacted with the last of the oxidizer, resulting in a flue gas.

In one embodiment, a number of reaction zones are each supported by a catalytic bed 455, indicated without limitation as a "Honeycomb Catalyst." A honeycomb catalyst is a structure having many parallel flow channels aligned to permit gases to flow through the structure. The flow channels may be hexagonal or have some other cross-sectional area that permits regular packing of the structure. The honeycomb is formed from or is coated with a catalytic material. Such catalysts are used as automotive catalytic converters, for example. Alternatively, the catalytic bed 455 could be comprised of catalytic pellets, spheres, or extrudates.

The reaction zones 450 are within the region in which the oxidizer flows. Fuel is provided to each reaction zone by a separate fuel line 452 terminating in a nozzle or injector 454 that promotes mixing of fuel and oxidizer before entry to the associated catalyst bed 455. The fuel reacts with the oxygen within the catalyst, forming a mixture of flue gases and residual oxygen. Additional fuel is provided before the next honeycomb catalyst and the process proceeds until the last honeycomb catalyst where the last of the fuel and oxidizer are reacted.

As shown in FIG. 4, the Inner Flow Passageway 403 provides for the flow of an oxidizer, as shown by axial arrows 420. One or more Fuel Lines 452 extend down the Burner 400, either within the Outer Flow Passageway 405 or within the Inner Flow Passageway 403. The Fuel Lines 452 provide fuel to the Heater, and terminates in one or more Fuel Injectors 454, which inject fuel into the oxidizer of the Inner Flow Passageway 403. In one embodiment, there is one Fuel Line having a number of Fuel Injectors and in another embodiment there is a bundle of Fuel Lines, each terminating with a Fuel Injector. Multiple fuel lines 452 may be placed symmetrically or asymmetrically around the Inner Flow Passageway 403.

The Flow Barrier 410 of the embodiment of FIG. 4 is not permeable, as in FIG. 3 and does not extend all of the way to the Closed Heater End 404. In addition, a number of Honeycomb Catalysts 455 allow the fuel and oxidizer to flow towards the Closed Heater End 404. Mixing of fuel an oxidizer occurs just before each Honeycomb Catalyst, and reactions between the fuel and oxidizer take place within each Honeycomb Catalyst. The Flue Gases flow from the Closed Heater End 404 through the Outer Flow Passageway 405, to the Gas Inlet/Outlet Portion 406.

In one embodiment, refractory materials are used near the point of fuel injection to protect the Heater from excess heat and corrosion. Thus in one embodiment, the Fuel Injectors are ceramic. In another embodiment, ceramic liners are provided to metal surfaces where fuel and oxidizer react or may react, such as near each Fuel Injector.

In various embodiments, air, $O_2$-enriched air, or pure $O_2$ is provided through the Inner Flow Passageway 403. Natural gas or other fuel is provided through a plurality of Fuel injectors 454 (one per Honeycomb Catalyst), where the fuel is metered, injected, and mixed with the gas in the Inner Flow Passageway 403. Thus, for example and without limitation, each fuel injection nozzle 454 is followed, downstream, by a oxidation catalyst bed 455 where the injected fuel gas is completely oxidized by the $O_2$ that is present in the oxidizer line. The oxidizer concentration decreases as the oxidizer flows through the heater. In one embodiment, sufficient oxidizer is provided to consume all of the fuel at the last honeycomb catalyst.

The catalytic bed of this embodiment can be of standard "honeycomb" design such as those used in automobile applications. Such honeycomb catalysts operate with a gas velocity of about 1-2 m/s (in order to make mass-transfer from the bulk gas to the Flow Barrier 410 possible in a reasonable channel length). The use of pure $O_2$ is therefore favorable for minimizing heater dimensions. To facilitate mixing, the fuel injection nozzles 454 are preferably placed closely after each catalyst bed 455 so that the following pipe sections provide both heat transfer and the mixing of fuel into the bulk gas. Efficient mixing is desirable because low gas velocity may cause mixing efficiency issues, potentially leading to so-called hotspots in the catalyst.

In one embodiment the catalytic bed includes an active metal supported by a porous ceramic catalytic material. In another embodiment, the catalytic bed 455 is the interior surface of a porous metal frit. In yet another embodiment, the catalytic bed 455 is an active metal supported by a porous metal frit or screen. In another embodiment, the catalytic bed 455 is comprised of porous beads, pellets, or extrudites supporting an active metal.

Figure 5:
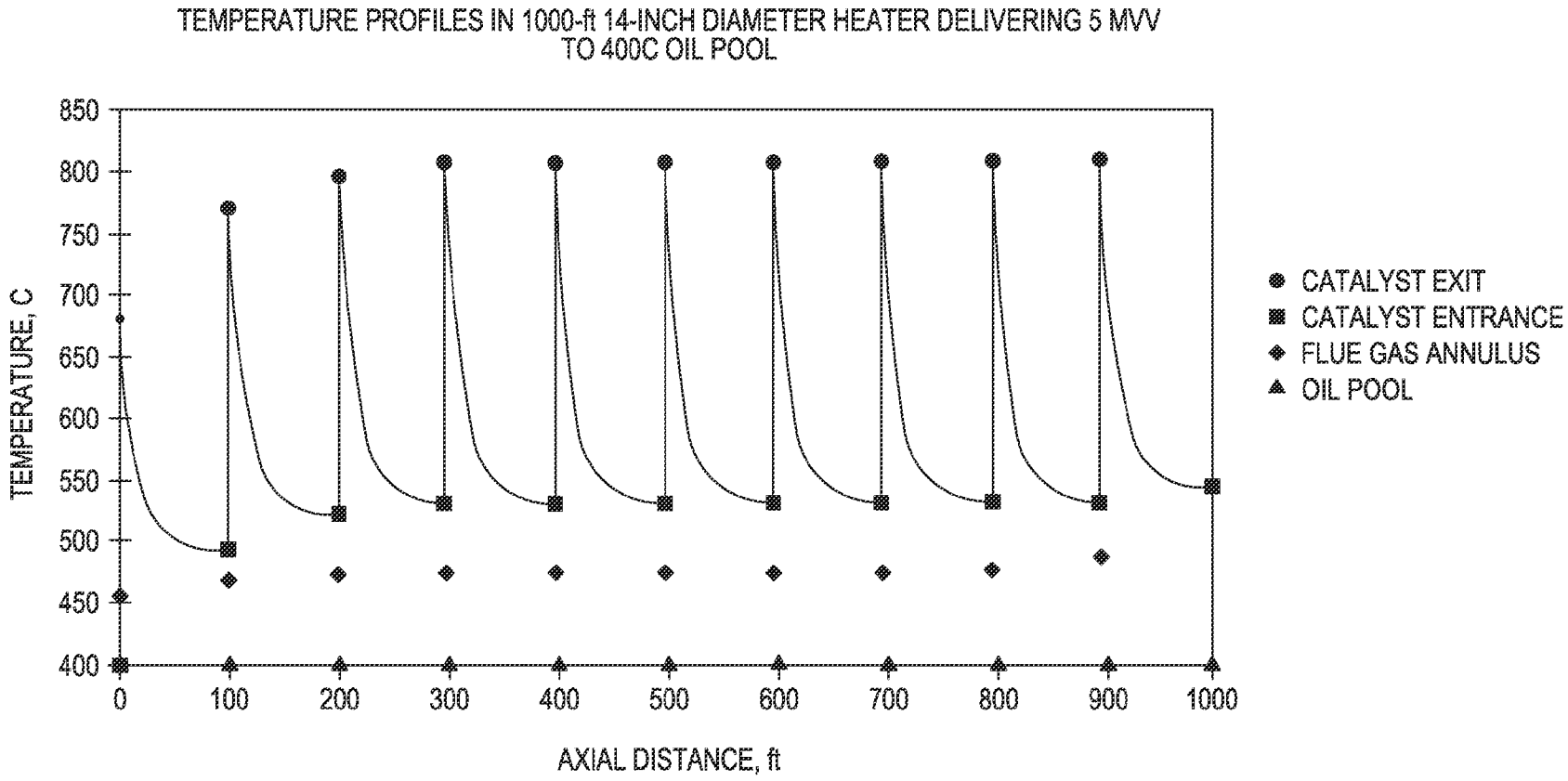
FIG. 5 shows the temperature distribution resulting from a numerical simulation of the performance of a Catalytic Bed Heater as shown in FIG. 4.

FIG. 5 shows the temperature distribution resulting from a numerical simulation of the performance of a specific embodiment of the heater embodiment of FIG. 4. The results of FIG. 5 show the first 10 of 20 reaction zones, at which the temperature profiles repeat almost identically at each zone. In this embodiment, 0.8 kg/s of pure $O_2$ is provided to the Inner Flow Passageway 403, and twenty Fuel Injectors for $CH_4$ are distributed 30 m apart over the length of the Heater. Each Fuel Injector 454 is fed with 0.01 kg/s $CH_4$. The overall Heater is thus rated at 10 MW and has a length of 600 m, an Inner Flow Passageway 403 diameter of 300 mm, and a Housing diameter of 350 mm.

The inner tube temperature profile is characterized by peaks after each honeycomb catalyst bed 455 of about 800 C, followed by a decrease in temperature due to heat transfer to a temperature of about 530 C. before the next honeycomb catalyst bed 455 is reached. This simulation includes convective heat transfer only and neglects radiative heat transfer, and thus is expected to over predict the actual heater temperatures. The flue-gas temperature is a nearly constant temperature of 470 C.

As one example of a system to control heater temperatures, FIG. 4 illustrates an embodiment having optional temperature sensors (TS) 460 to measure the casing temperature along the Heater. As shown, each catalyst bed 455 has an associated temperature sensor 460. The control system shown schematically in FIG. 2 may be included in this or other embodiments, as appropriate. Each sensor has communications means, such as an electrical or fiber optic communication channel, to a controller 200, as shown for example in FIG. 2. The temperature uniformity along the Heater 400 may be controlled by changing individual fuel flow rates to increase or decrease the measured temperatures.

In alternative embodiments, a high-temperature burner replaces one or more of the Honeycomb Catalyst beds 455 of FIG. 4, forming a combined Catalyst Bed/Burner-Based Heater, or in the extreme, a fully Burner-Based Heater. Each burner fires axially into the Inner Flow Passageway 403 without flame impingement on the surrounding steel wall. In one embodiment, a ceramic liner is provided inside the Inner Flow Passageway 403 to protect that surface.

In another alternative embodiment, a low-BTU fuel gas (which contains inert components) is used as a fuel. For such a fuel, it may be advantageous to reverse the operation of the heater embodiment of FIG. 4 by having the fuel directed down the center and the oxidizer feed separately by individual pipes feeding the reaction zones. This configuration may have the benefit of controlling the amount of heat generation more precisely in each section.

Catalytic-Wall Heater

Figure 6:
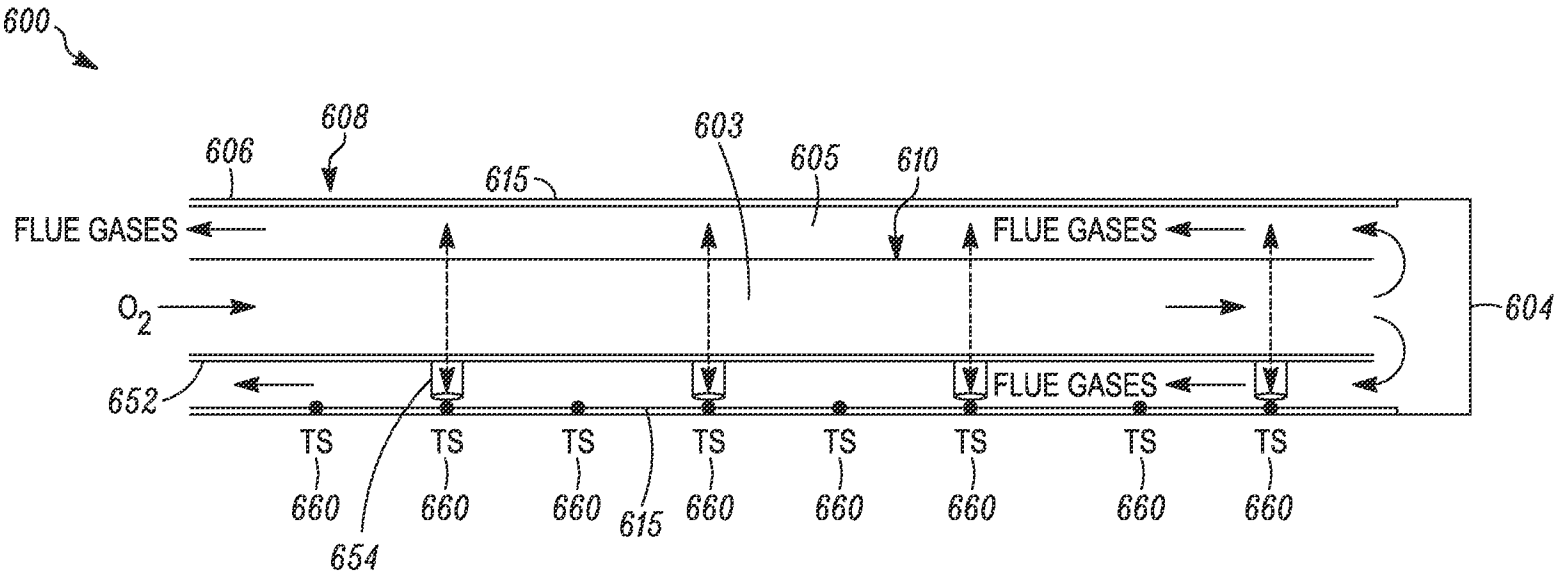
FIG. 6 is a schematic illustrating yet another exemplary embodiment of a heater in the form of a Catalytic-Wall Heater.

Another embodiment of a heater is shown in FIG. 6 as a Catalytic-Wall Heater 600. The heater embodiment of FIG. 6 may include one or more of the elements described above, as appropriate. As in the embodiment of FIG. 4, the Flow Barrier 610 does not extend to the Closed Heater End 604. Oxidizer is provided through the Inner Flow Passageway 603, where it flows to the Closed Heater End 604, and then flows through the Outer Flow Passageway 605 to the Gas Inlet/Outlet Portion 606. One or more Fuel Lines 652 include a plurality of Fuel Injectors 654 that direct fuel into the Outer Flow Passageway 605. The inner surface of the Burner Housing or casing 608 includes a Catalyst 615. The fuel and oxidizer thus mix along the length of the Heater 600 and react on the Burner Housing Surface. As shown in the figure multiple injection points 654 may be positioned about the circumference of inner tube 610.

In alternative embodiments, air or oxygen-spiked recycled flue gas is provided through the Inner Flow Passageway 603, which serves as an air delivery tube to the Closed Heater End 604. The oxidizer then flows back, counter to the inflow, in the Outer Flow Passageway 605. The Heater Housing 608 includes a catalyst covering the inner surface of the Heater Housing 608, forming a catalytic wall 615. Fuel Injectors 654 are part of a manifold of the Fuel Lines 652, and deliver fuel to the oxidizer along the length of the heater. The Fuel Injectors 654 are sized and spaced such that all the injected fuel is transferred by diffusion and turbulent mixing to the catalytic wall 615 in the downstream pipe section before the next fuel nozzle. Catalytic-enhanced exothermic reactions occur at the catalyst, where the mixture is oxygen-rich near the closed end of the heater and near stoichiometric at the other end. The wall is thus maintained at a temperature around 500 C along the length of the heater.

In alternative embodiments, the catalytic wall 615 is moved from the outside tube to the inside tube to enable heat transfer at a lower temperature through the outside wall. In one alternative embodiment, the catalytic wall is on the outside of the inner tube 610. In a second alternative embodiment, the flows are reversed and the catalytic wall 615 is on the inside of the inner tube 610. In this embodiment, the fuel injectors 654 may be located within the inner tube.

In one embodiment, the catalytic wall 615 is a series of ceramic tubes, which may be for example and without limitation, activated alumina or alumina coated with an active metal. The small gap between the alumina tubes and the steel pipe can be made gas-tight by a compressed and flexible mat installed in the gap at suitable locations. An alternative design of the wall catalyst is a metallic "mat-type" catalytic material that can be directly attached to the steel surface.

This heater embodiment lends itself to recycling of flue gas within the heater: the low pressure drop in both the inner feed tube and the outer annulus makes a standard ejector possible at the outlet of the flue-gas side so that a fraction of the flue gas is sucked into the feed to the inner tube. The motive gas for this ejector is the high-pressure $O_2$ feed from the surface facility. This embodiment has the advantage of providing a smaller flue gas volume consisting of only $CO_2$ and $H_2O$.

This heater embodiment also makes use of additional countercurrent heat exchange between the hotter flue-gas side and the incoming air (or $O_2$-spiked recycle gas). The heater can also be designed so that the incoming gas flow goes down the outside annulus and the exiting flue gas goes down the inside annulus.

As another example of a system to control heater temperatures, FIG. 6 illustrates an embodiment having temperature sensors (TS) 660 to measure the casing temperature along the Heater. Temperature sensors 660 and the control system shown schematically in FIG. 2 may be included in this or other embodiments, as appropriate. Each sensor has communications means, such as an electrical or fiber optic communication channel, to a controller 200, as shown for example in FIG. 2. The temperature uniformity along the Heater 600 may be controlled by changing individual fuel flow rates to increase or decrease the measured temperatures.

Reference throughout this specification to "one embodiment," "an embodiment," or "certain embodiment" means that a particular feature, structure or characteristic described in connection with the embodiment is included in at least one embodiment. Thus, appearances of the phrases "in one embodiment," "in an embodiment," or "in certain embodiments" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Accordingly, the technology of the present application has been described with some degree of particularity directed to the exemplary embodiments. It should be appreciated, though, that the technology of the present application is defined by the following claims construed in light of the prior art so that modifications or changes may be made to the exemplary embodiments without departing from the inventive concepts contained herein.

The invention claimed is:

1. A heater operable on a fuel supply and an oxidizer supply, said heater comprising:

an elongated housing having a closed end and including:

a first housing region adapted to accept fluids from the fuel supply and the oxidizer supply; and a second housing region providing an outflow path for flue gases created by reaction of the fuel and the oxidizer; and an elongate flow restriction medium including a catalytic material, interposed between said first and second housing regions, wherein a permeability of the catalytic material increases with distance along the heater;

wherein fluids accepted from the fuel supply and the oxidizer supply flow into said first housing region, permeate said flow restriction medium along its length, and react exothermically with said catalytic material; and wherein said flow restriction medium is in the form of a tube positioned concentrically within said housing and extending to the closed end, so as to create a pressure drop across the flow restriction medium between the first and second housing regions.

2. The heater of claim 1, wherein said housing has a tubular configuration.

3. The heater of claim 1, wherein said flow restriction medium has an interior defining said first housing region.

4. The heater of claim 1, wherein said fluids flow transversely in a controlled and uniform manner through said flow restriction medium.

5. The heater of claim 1, wherein the heater is immersible in an oil pool, and wherein the flow rates of supplied fuel and oxidizer are such that the exothermic reaction is sufficient to heat the inner surface to maintain the oil pool to a temperature between 275 C and 450 C.

6. The heater of claim 5, wherein the exothermic reaction is sufficient to heat the inner surface to maintain the oil pool to a temperature of approximately 350 C.

7. The heater of claim 5, wherein the housing temperature varies by less than 10 C over 10 m of heater length.

8. The heater of claim 5, wherein the housing temperature varies by less than 20 C over 10 m of heater length.

9. The heater of claim 5, wherein the housing temperature varies by less than 40 C over the length of the heater.

10. The heater of claim 5, wherein the housing temperature varies by less than 100 C over the length of the heater.

11. The heater of claim 1, wherein the fluids in the first housing region flow towards the closed end, and wherein the flue gases in the second housing region flow away from the closed end.

12. The heater of claim 1, wherein the flue gases are recycled through an ejector type recycle compressor.

13. A method of providing heat for pyrolyzing a hydrocarbon formation, the method comprising:

inserting an elongate housing into the hydrocarbon formation, the housing having a closed end, a first housing region adapted to accept fluids from the fuel supply and the oxidizer supply, a second housing region providing an outflow path for flue gases created by reaction of the fuel and the oxidizer, and an elongate flow restriction medium including a catalytic material, interposed between said first and second housing regions, wherein a permeability of the catalytic material increases with distance along the heater;

injecting an oxidizer and a fuel into said first housing region of said housing;

flowing at least one of said oxidizer and said fuel through a flow restriction medium including a catalytic material, wherein said flow restriction medium is in the form of a tube positioned concentrically within said housing and extending to the closed end, so as to create a pressure drop across the flow restriction medium between the first and second housing regions; and reacting said fuel and said oxidizer exothermically with said catalytic material.

14. The method according to claim 13 including evacuating flue gases created by reacting said fuel and said oxidizer from said housing.

15. The method according to claim 14 including heating at least one of said oxidizer and said fuel with said flue gases.

16. The method according to claim 13 including controlling the injection of oxidizer and fuel to maintain an oil pool surrounding said housing at a temperature between 275 C and 450 C.

* * * * *